US005722785A

United States Patent [19]

Diener

[11] Patent Number: 5,722,785

[45] Date of Patent: Mar. 3, 1998

[54] TOOL FASTENING DEVICE FOR TECHNOSCOPES

[75] Inventor: Jörg Diener, Oberderdingen, Germany

[73] Assignee: Richard Wolf GmbH, Knittlingen, Germany

[21] Appl. No.: 721,936

[22] Filed: Sep. 27, 1996

[30] Foreign Application Priority Data

Oct. 2, 1995 [DE] Germany ..... 195 36 557.7

[51] Int. Cl.[6] ..... B25F 1/00; B24B 21/20

[52] U.S. Cl. ..... 403/202; 403/299; 403/343; 408/16

[58] Field of Search ..... 403/202, 342, 403/343, 299; 83/178, 187; 356/237, 241; 408/16; 409/143, 133; 451/27, 6, 462, 521

[56] References Cited

U.S. PATENT DOCUMENTS

| | | | |
|---|---|---|---|
| 3,719,254 | 3/1973 | Snider | 184/64 |
| 3,843,143 | 10/1974 | Laxson | 403/299 X |
| 4,304,511 | 12/1981 | Machida | 408/16 X |
| 5,155,941 | 10/1992 | Takahashi et al. | 408/16 X |
| 5,238,338 | 8/1993 | Stucky | 409/143 |
| 5,349,940 | 9/1994 | Takahashi et al. | 356/241 X |
| 5,475,485 | 12/1995 | Diener | 356/241 |

FOREIGN PATENT DOCUMENTS 42 41 767 C1 12/1993 Germany .

*Primary Examiner*—Anthony Knight
*Attorney, Agent, or Firm*—Cohen, Pontani, Lieberman, Pavane

[57] ABSTRACT

The present invention relates to a device for fastening a rotatory drivable tool to the head of a technoscope by screwing a tool holder provided at the proximal side end of the tool to the distal end of the shank of a drive spindle. To secure undesired detaching of the tool from the technoscope, the tool holder is additionally screwed onto and against a cylinder sleeve which is run through by the shank of the drive spindle and rotatably mounted in the technoscope head.

8 Claims, 2 Drawing Sheets

1
2
3
4
5
6
6a
7
8
9
10
II
II
14
15
16
17
18
20
21
22
24

TOOL FASTENING DEVICE FOR TECHNOSCOPES

BACKGROUND OF THE INVENTION

1. Field of the Invention

The present invention relates to a device for fastening a rotatory drivable tool to the head of a technoscope or other similar drive device, and more particulary, to a tool holder removably connected to the end of a technoscope, the tool holder having a cynlindrical sleeve having a center bore through which passes a drive spindle, both the sleeve and drive spindle being screwed to the tool holder.

2. Description of the Art

Devices for fastening rotatory drivable tools to the heads of technoscopes are known in the art. German Patent Number DE-C4241767 discloses such a device for a technoscope. The technoscope described in DE-C4241767 is an instrument for machining the surface of parts in enclosed cavities. The technoscope has a tool and an optical viewing device for observing the surface machining in real time. The tool may, for example, be a drill cutter or a grinding attachment.

With the help of such instruments, repairs in normally inaccessible enclosed spaces, such as engine blades of turbine engines, may be carried out without having to undertake a time consuming and thus costly disassembly and reassembly of the engine blades. For this purpose inspection holes are provided in the turbine housing and through which such an instrument may be inserted, so that for, example, small dents in the front or rear edges of the blades can be machined. One must be sure that in such enclosed cavities, the tool does not unintentionally drop from the distal end of the technoscope shank, since this would then necessitate the disassembly of the engine, which is expensive time consuming and laborious.

SUMMARY OF THE INVENTION

It is therefore the object of the present invention to so design a fastening device for a rotatory drivable tool such that a secure connection between the tool and the technoscope head is guaranteed.

With the fastening device according to the present invention, a tool holder, provided at the proximal end of a tool, is screwed onto and against a sleeve which is rotatably mounted in the head of the technoscope. The distal end of the shank of a drive spindle is screwed to the tool holder at the proximal end of the tool with the shank of the drive spindle passing through the sleeve.

The sleeve is rotatably mounted at the technoscope, or other similar drive device head that it operably rotates with the drive spindle, whereby the sleeve and the drive spindle are securely screwed to the tool holder by way of the double screw connection.

The tool holder comprises a first and a second coaxial internal thread. The distal end of the shank of the drive spindle is provided with a coaxial external thread, and the sleeve also comprises a coaxial external thread at its distal end, whereby in the screwed condition, the first internal thread of the tool holder is screwed onto the external thread of the shank and the second internal thread of the tool holder is screwed onto the external thread of the sleeve. All these threads have an opening rotational direction, which is opposite with respect to the foreseen rotational direction of the machining, i.e. rotation of the tool holder tightens the screw connection between the tool holder and sleeve and between the tool holder and drive spindle.

The connection of the tool or tool holder to the technoscope or other similar drive device is effected as follows:

- the tool holder is firstly screwed with its first internal thread to the external thread of the sleeve whereby advantageously spanner flanks are provided on the sleeve so that a torsional securement can be achieved when screwing on with the help of fork spanner;
- subsequently the second internal thread of the tool holder is screwed to the external thread of the spindle shank whereby at the opposite free end of the drive spindle there is provided another engagement surface for an assembly tool, for example a screwdriver or alternatively an Allen key, in order to allow a torsional securement by hand when screwing the tool holder onto the spindle shank.

Because the opening rotational direction of the threads are opposite to the rotational direction of machining, in operation, the tool automatically tightens further. Undesired loosening of the tool is thus no longer possible.

In the screwed condition the tool holder lies adjacent one flank of a radial flange of the sleeve and the other flank of the flange is supported at an axial bearing located in the technoscope. In this way the position of the drive spindle together with the tool is fixed in the axial direction.

The axial bearing is permanently connected to the sleeve using for example an adhesive connection, is accomodated by an annular space which is formed in the technoscope and open towards the flange of the sleeve, and is supported at the base of the annular space. Furthermore a radial sliding beating for the sleeve is provided in the technoscope head.

DETAILED DESCRIPTION OF THE PRESENTLY PREFERRED EMBODIMENT

Figures 1, 2, 3, 4:
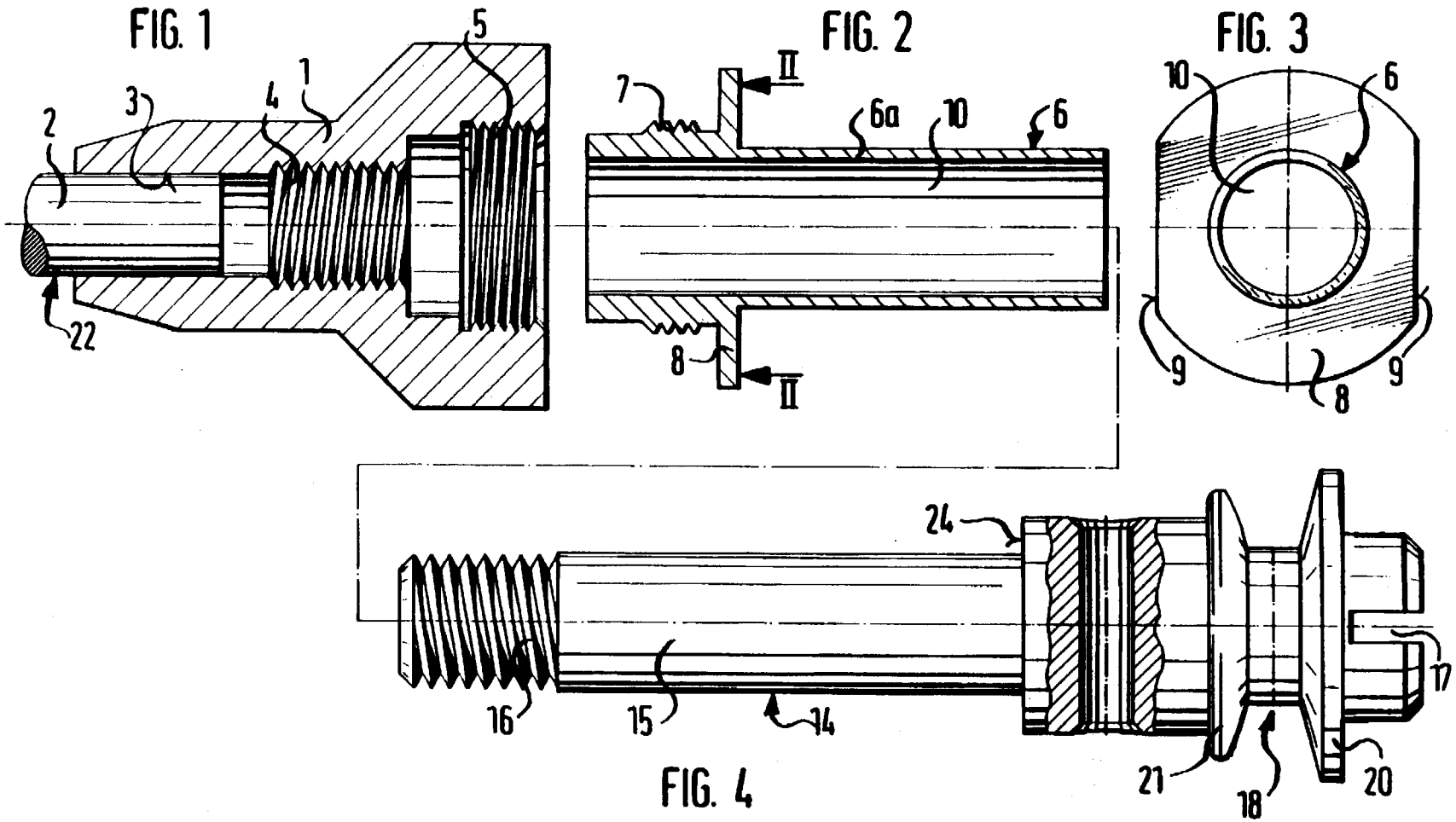
FIG. 1 is a longitudinal cross-sectional view through the proximal end of a tool with the tool holder, constructed in accordance view with the present invention.
FIG. 2 is a longitudinal cross-sectional of a cylinder sleeve constructed in accordance with the present invention.
FIG. 3 is a plan view of a flange of the cylinder sleeve of FIG. 2.
FIG. 4 is a partial cross-sectional view of a drive spindle constructed in accordance with the present invention.

Referring now to the drawings in detail, the FIG. 1 shows a tool holder 1 located at the proximal end of a tool 22. The tool itself, for example a grinding head, is not shown completely, but only its cylindrical tool shank 2. The proximal end of the tool shank 2 is unreleasably fastened in a bore 3 of the tool holder 1. Axially following this tool shank 2, the tool holder 1 comprises a first coaxial internal thread 4, a coaxial widening and a second coaxial internal thread 5. The thread diameter of the second internal thread 5 is larger than that of the first internal thread 4 of the tool holder 1.

A sleeve 6 according to FIG. 2 has an external thread 7, a central bore 10, a proximally extending shank 6*a* and a flange 8 following the external thread 7.

FIG. 3 shows a plan view of the sleeve 6 and in particular of its flange 8 in the direction of the arrows II—II in FIG. 2. The flange 8 has parallel flanks 9 which serve as engaging surfaces for a tool for securing the cylinder sleeve 6 when screwing on the tool holder 1.

For connecting the machining tool with the head 13 of the technoscope or other similar drive device (FIG. 5), the tool holder 1 is screwed onto the sleeve 6, whereby the second internal thread 5 of the tool holder 1 and the external thread 7 of the sleeve 6 engage into one another. In the screwed condition the proximal end side of the tool holder 1 lies adjacent the distal flank of the flange 8.

FIG. 4 shows a drive spindle 14 having an externally threaded distal end which rotatably via a sleeve 6 in the technoscope head 13, and which runs with its shank 15 through a central bore 10 of the sleeve 6. An external thread 16 is provided at the distal end of the shank 15, for connecting the spindle 14 to the tool holder 1. At the proximal end of the spindle 14, a slit 17 is provided for a screwdriver (not shown) when screwing-in the thread 16 of the spindle 14 into the thread 4 of the tool holder 1.

At its proximal end, the spindle 14 may comprise a guide roller 18 for a drive belt 25 (FIG. 5) driving the spindle 14. At the same time slot flanks 20, 21 guiding the drive belt may differ in size, with slot flank 20 having a larger diameter than slot flank 21. This serves to prevent the jumping-off of the drive belt when the position of the head 13 is tilted.

In an alternative embodiment, the spindle 14 in the device may be driven by a suitably chosen gearing instead of using drive belt 25. Instead of providing a slit 17 for receiving a screwdriver at the drive spindle 14, an axial hexagonal socket for receiving an Allen key may be provided.

Figure 5:
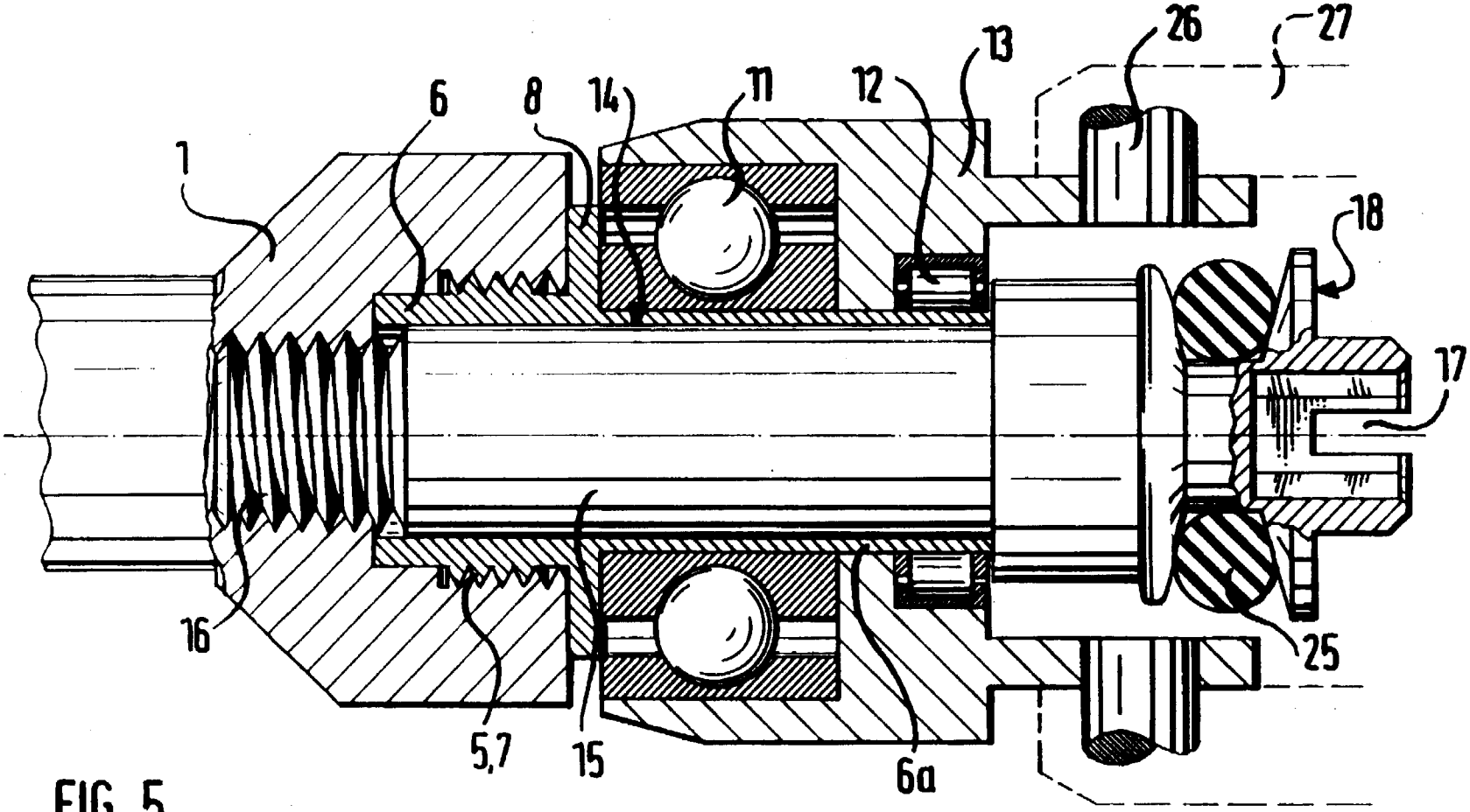
FIG. 5 is the drive spindle FIG. 4, the cylinder sleeve of FIG. 2 and the tool holder of FIG. 1, assembled in accordance with the present invention.

In the screwed together condition of the tool holder 1, the sleeve 6 and the drive. spindle 14, the proximal end side of the sleeve 6 lies adjacent a flank 24 formed at the distal end of the drive spindle 14. The sleeve 6 for its part, as is explained hereafter by way of FIG. 5, is permanently connected to an axial bearing 11 lying in the technoscope head 13.

The sleeve 6 is connected to the axial ball bearing 11 for example by conventional adhesives. In addition to the ball bearing 11, a sliding bearing 12 is provided in the head 13 of the technoscope, so that the sleeve 6 is rotatably mounted on the technoscope head 13 and the technoscope 13 is pivotally mounted by way of the drag bearing 26 in part 27 of the technoscope shank.

As has already been mentioned, the tool holder 1 with its second internal thread 5 is screwed onto the external thread 7 of the sleeve 6 with the aid of a fork spanner engaging on the flanks 9 of the flange 8. The spindle 14 with its external thread 16 at the distal side is then screwed and tightened onto the first internal thread 4 of the tool holder 1 with the help of a screwdriver engaging into the screw slit 17 or an Allen key engaging a hexagonal socket. In this way the threads 4, 16 are twisted against the threads 5, 7. In the finished assembled condition, the proximal flank of the flange 8 is supported on the flank of the axial beating 11 lying in the head 13 on the distal side (FIG. 5). The axial bearing 11 lies in an annular space formed in the head part 13 and is supported on the base of the annular space. A further annular space in the head 13 accomodates the radial sliding bearing 12 for the sleeve 6.

In order to prevent an unscrewing of the threads 4, 16 and 5, 7 due to the opposing rotational moments occuring during the machining procedure, these threads have, in comparison to the foreseen rotational machining direction of the tool, an opposing rotational direction of opening.

The releasing of the tool or the tool holder 1 after completion of the machining procedure is effected in the reverse sequence to the fastening procedure, i.e. that first the shank 15 of the spindle 14 is screwed out of the tool holder 1 and then cylinder sleeve 6 is unscrewed from the tool holder 1 is unscrewed from the cylinder sleeve 6.

What is claimed is:

1. An apparatus for fastening a rotary drivable tool (22) having a proximal end to a drive device having a head (13), said apparatus comprising:

a tool holder (1) having a proximal end and a distal end with the tool (22) being fixedly mounted to said tool holder (1) at said distal end;

a sleeve (6) having a distal end removably and threadedly mounted in a close confronting relation to said proximal end of said tool holder (1) and having a cylindrical bore therethrough, said sleeve (6) being rotatably mounted in the head (13); and a drive spindle (14) having a free end and a shank portion (15) having a distal end removably and threadedly mounted to said proximal end of said tool holder (1), said shank portion (15) passing through said bore of said sleeve (6).

2. The fastening apparatus as defined in claim 1 further comprising:

a first internal threaded portion (4) positioned internal to said proximal end of said tool holder (1);

a second internal threaded portion (5) coaxial to said first threaded portion (4) and positioned internal to said proximal end of said tool holder (1);

a first external threaded portion (16) positioned at said distal end of said shank portion (15) of said drive spindle (14); and a second external threaded portion (7) positioned at said distal end of said sleeve (6);

said second internal threaded portion (5) of said tool holder (1) mating with said second external threaded portion (7) of said sleeve (6) when said sleeve (6) is removably and threadedly mounted in close confronting relation to said tool holder (1) and said first internal threaded portion (4) of said tool holder (1) mating with said first external threaded portion (16) of said distal end of said shank portion (15) of said drive spindle (14) when said drive spindle (14) is removably and threadedly mounted to said tool holder (1) with said shank portion (15) of said drive spindle (14) passing through said bore of said sleeve (6).

3. The fastening apparatus as defined in claim 2, wherein the tool (22) rotates in an operational direction and wherein said first internal threaded portion (4) and said first external threaded portion (16) and said second internal threaded portion (5) and said second external threaded portion (7) have an opening rotational direction which is opposite to the operational direction of the tool (22).

4. The fastening apparatus as defined in claim 1, wherein the head (13) has an annular opening defined therein, said apparatus further comprising:

an axial bearing (11) disposed within the annular opening for rotatable movement of said sleeve (6) within the head (13); and a radial flange (8) disposed about said sleeve (6) having a first flank adjacent said tool holder and a second flank supported by said axial bearing (11).

5. The fastening apparatus as defined in claim 4, wherein said radial flange (8) further comprises a plurality of engagement surfaces (9, 17) for engagement with an assembly tool for removably and threadedly mounting said sleeve (6) to said tool holder (1).

6. The fastening apparatus as defined in claim 4, wherein said drive spindle (14) further comprises an engagement surface (17) positioned at said free end of said drive spindle (14) for engagement with an assembly tool for removably and threadedly mounting said sleeve (6) to said tool holder (1).

7. The fastening apparatus of claim 4, wherein said axial bearing (11) is fixedly connected to said sleeve (6).

8. The fastening apparatus as defined in claim 7, wherein the head (13) of the drive device has a second annular opening defined therein, said apparatus further comprising a sliding radial bearing (12) disposed within the second annular opening for rotatable movement of said sleeve (6) within the head (13).

* * * * *